United States Patent [19]

Schmale

[11] 4,406,035

[45] Sep. 27, 1983

[54] HINGE ASSEMBLY STRIP

[75] Inventor: Karl-Ernst Schmale, Lüdenscheid, Fed. Rep. of Germany

[73] Assignee: Schmale GmbH & Co. KG, Lüdenscheid, Fed. Rep. of Germany

[21] Appl. No.: 114,315

[22] Filed: Jan. 22, 1980

[30] Foreign Application Priority Data

Sep. 11, 1979 [DE] Fed. Rep. of Germany ..... 2936603

[51] Int. Cl.[3] ..... E05D 5/06

[52] U.S. Cl. ..... 16/384

[58] Field of Search ..... 16/162, 159, 168, 377, 16/384, 387, 388; 29/11

[56] References Cited

U.S. PATENT DOCUMENTS 1,134,100 4/1915 Breckenridge ..... 16/162

2,714,741 8/1955 Derman ..... 16/159

FOREIGN PATENT DOCUMENTS 1925709 11/1970 Fed. Rep. of Germany ..... 16/159

*Primary Examiner*—Wayne L. Shedd

*Attorney, Agent, or Firm*—Spencer, Kaye & Frank

[57] ABSTRACT

A longitudinally extending hinge assembly strip of indeterminate length is formed of a series of hinges connected to one another. Each hinge includes first and second hinge plates pivotally coupled along adjoining longitudinal edges by a hinge joint which, in turn, has a longitudinally extending hinge pin. Each hinge plate has at least one free edge and a rim extending along the free edge and having a plane substantially perpendicular to the hinge plate. Further, each hinge plate has at least one drive-in point which is coplanar with the plane of the respective rim.

13 Claims, 9 Drawing Figures

HINGE ASSEMBLY STRIP

BACKGROUND OF THE INVENTION

This invention relates to a strip-like hinge assembly of indeterminate length made of flat material, such as sheet metal and formed of a plurality of hinges. The hinges which are thus connected to form a longitudinal series, each have two hinge plates pivotally coupled to one another at their abutting edges by means of a hinge pin. Further, each hinge plate has components, by means of which the hinge is forcibly introduced into and frictionally held in parts which are to be pivotally attached to one another by the hinge assembly strip.

Hinge assemblies of the above-outlined type serve, for example, for the pivotal attachment of a lid to a container made of wood, cardboard or synthetic material. One of the hinge plates is secured to the lid while the other is secured to a marginal zone of a container side. For this purpose, as noted above, the hinge plates have components which are driven into the lid and the container and which are frictionally held therein. The hinges may be individually mounted. For increasing the efficiency of the hinge mounting operation, it is known to combine the hinges into a strip-like series of indeterminate length. The hinge assembly strip may be stored and shipped in reels and unwound for mounting, in determined lengths, on the parts that are to be hinged together. The assembly strip is, by means of a tool, fed intermittently to an impacting machine in which the hinge assembly strip is cut into the desired length which is then simultaneously secured to the lid and the container. The components which hold the hinges on the respective pivotal parts may be drive-in points (particularly if the pivotal parts are wood or cardboard) or clamps (jaws) for insertion into slots of the pivotal parts (particularly if the parts are made of synthetic material).

The known hinge assembly strips have been formed heretofore of hinge plates which extend in only one plane. The drive-in points or similar components are arranged in that plane and are angularly bent at the outer longitudinal edges.

SUMMARY OF THE INVENTION

It is an object of the invention to provide an improved hinge assembly strip of indeterminate length which may find more extended application than prior art structures and which, among others, has an increased stiffness and twist-resistance and thus is particularly adapted for use in large containers, such as suitcases, crates and the like.

This object and others to become apparent as the specification progresses, are accomplished by the invention, according to which, briefly stated, each hinge plate of each hinge has, at least along one bounding edge, a rim bent at 90° with respect to the plane of the hinge plate and each rim is provided with a drive-in point lying in the plane of the rim.

The invention combines, in a particularly advantageous manner, a hinge having particularly superior torsion-resistant properties and components for the forcible introduction into lid parts and container parts, with the possibility of connecting such hinges into a hinge assembly strip and to readily store, ship and feed such a strip to an impacting device.

DESCRIPTION OF THE PREFERRED EMBODIMENTS

Each hinge assembly strip has a plurality of hinges connected to form a strip of indeterminate length; in each Figure only three or four such interconnected hinges are shown. The hinge assembly strip is bundled in linear length portions or is wound in reels, stored and shipped in this condition and is eventually mounted for use by means of a cutting and impacting tool.

Figure 1:
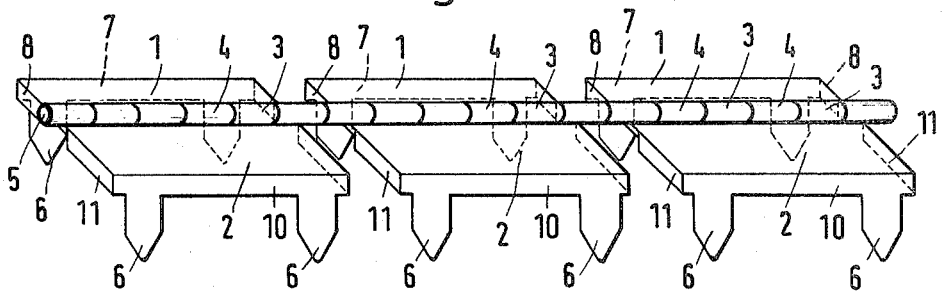
FIG. 1 is a perspective view of a preferred embodiment of the invention.

Turning now to FIG. 1, each hinge of the hinge assembly strip shown therein is formed of two hinge plates 1 and 2 which have a rectangular outline and which, along their longitudinal edges oriented towards one another, have circularly bent parts 3 and 4, respectively. The parts 3 and 4 extend into one another in an interleaving relationship and accommodate a throughgoing, continuous hinge pin 5. The parts 3 and 4 as well as the hinge pin 5 together constitute a hinge joint overlying the hinge plates 1 and 2; that is, the hinge joint is situated above the plane in which the hinge plates 1 and 2 lie when they are open and thus assume a coplanar relationship. The individual hinges are connected to one another by the hinge joint, more particularly, by the continuous hinge pin 5 to form a hinge assembly strip of indeterminate length. The hinge plate 1 has along its free longitudinal edge a downwardly bent rim 7 and further has, along both transverse bounding edges, downwardly bent respective rims 8. In a similar manner, the hinge plate 2 has along its free longitudinal edge a downwardly bent rim 10 and further has, along both transverse bounding edges, downwardly bent rims 11. The rims 7 and 10 have a plane which is substantially perpendicular to the plane of the respective hinge plates 1 and 2. The longitudinal rims 7 and 10 are provided with integral drive-in points 6 extending downwardly from the respective rims and being coplanar therewith.

Figure 2:
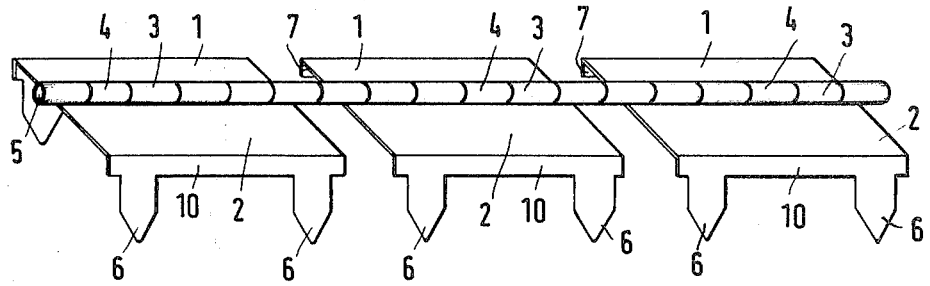
FIG. 2 is a perspective view of another preferred embodiment of the invention.

The embodiment illustrated in FIG. 2 differs from that of FIG. 1 in that the hinge plates 1 and 2 are provided with angularly bent rims 7 and 10—together with the drive-in points 6—only along their longitudinal edges, that is, along their edges extending parallel to the length dimension of the hinge assembly strip.

Figure 3:
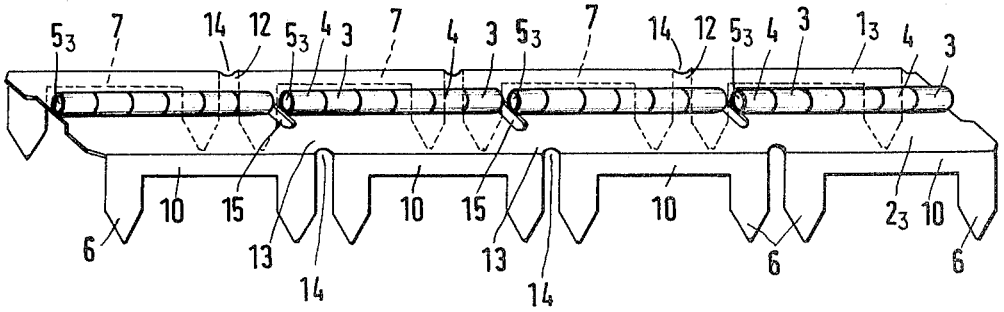
FIG. 3 is a perspective view of another preferred embodiment of the invention.

Turning now to the embodiment illustrated in FIG. 3, the hinge pin is not a continuous component as in the previously described embodiments; rather, it is divided into length portions $5_3$ which correspond to the length of the individual hinge. The hinge assembly is made coherent by providing that the hinge plates $1_3$ and $2_3$ are continuous in the longitudinal direction. Thus, between the successive hinge plates $1_3$ there is provided an intermediate integral part 12, while between hinge plates $2_3$ there is provided an intermediate integral part 13. The intermediate parts 12 and 13 are bounded by notches 14 at the outer longitudinal edges of the hinge plates $1_3$ and $2_3$ as well as by slots 15 between the circularly bent portions 3 and 4 of adjoining hinges. The intermediate parts 12 and 13 need not become waste during installation of the hinge assembly; much rather, it is feasible to cause the impacting tool to sever adjoining hinges from one another precisely medially of the plane defined by notches 14 and the slot 15.

Figure 4:
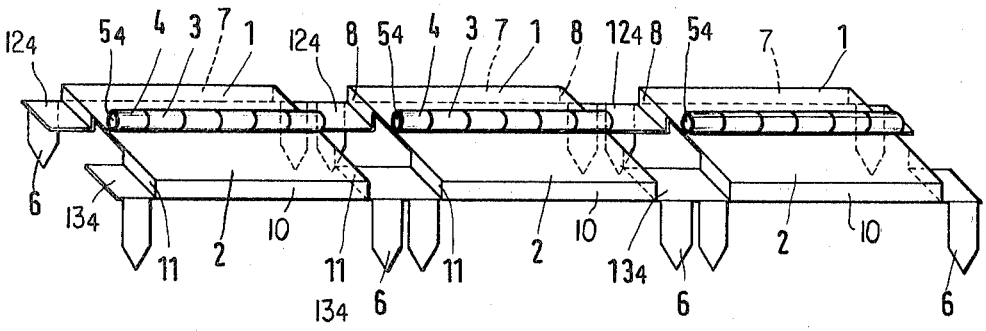
FIG. 4 is a perspective view of another preferred embodiment of the invention.

Turning now to the embodiment shown in FIG. 4, here too, similarly to the FIG. 3 embodiment, the hinge pin $5_4$ is discontinuous; thus, each hinge has its own separate hinge pin. In the embodiment shown in FIG. 4, the rim 8 at the transverse edges of the hinge plates 1 is bent back into a position in which it extends parallel to the plane defined by the hinge plates 1 to thus constitute an intermediate, connecting part $12_4$. Similarly, the rim 11 at the transverse edges of each hinge plate 2 is bent back to extend parallel to the plane defined by the hinge plates 2 to thus constitute an intermediate connecting part $13_4$. The drive-in points 6 are formed at the ends of the intermediate parts $12_4$ and $13_4$ and are so angled with respect to the parts $12_4$ and $13_4$ that they lie substantially in the plane defined by the longitudinal rims 7 (at the hinge plates 1) and 10 (at the hinge plates 2).

Figure 5:
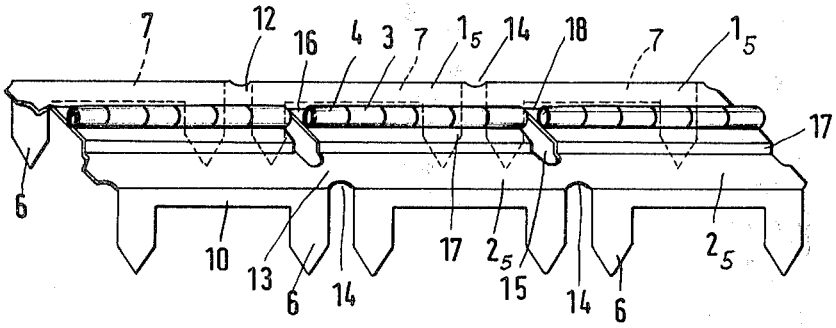
FIG. 5 is a perspective view of another preferred embodiment of the invention.

Turning now to the embodiment illustrated in FIG. 5, the hinge assembly strip is structured similarly to that of the FIG. 3 embodiment with the following differences: the hinge plates $1_5$ each have a longitudinally extending elevated portion 16 and the hinge plates $2_5$ each have a corresponding longitudinally extending elevated portion 17. The purpose of these elevated portions 16 and 17—which extend over the entire length of the respective hinge plates—is to conform the hinges to the edge contour of the article on which the hinge or hinge assembly strip is installed. This arrangement thus ensures that the hinge assembly strip fully conforms with the receptacle edge even at the reinforced parts after the hinge assembly strip has been driven in by means of the drive-in points 6.

Figure 6:
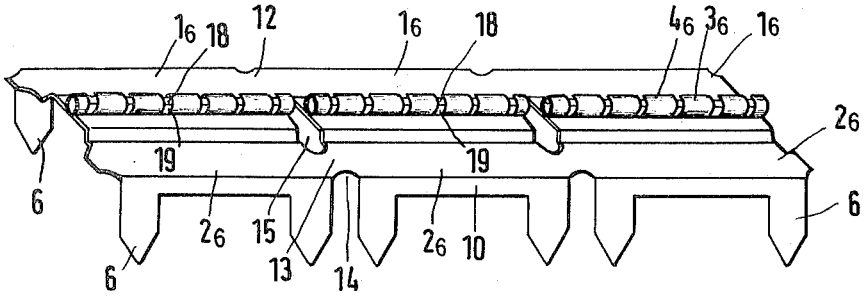
FIG. 6 is a perspective view of another preferred embodiment of the invention.

The hinge assembly strips according to the invention described heretofore provide for an unlimited (360°) hinging angle for the relative pivotal motion of the hinge plates. Therefore, theoretically, the latter may be moved from a position in which they are in a superposed, overlying relationship, about 360° into a position in which their undersides are in a face-to-face relationship, to the extent permitted by the drive-in points 6 as well as the rims 7, 8, 10 or 11. In contradistinction, the embodiment illustrated in FIG. 6 includes means for limiting the pivotal angle. Thus, at least some portions of the hinge joints formed of the arcuately bent hinge parts $3_6$, $4_6$ have, at the hinge plate $1_6$, at least one helically extending projection 18 constituting an abutment. The corresponding parts of the other hinge plate $2_6$ have similar rotationally symmetrical projections 19. The projections 18 and 19 provide for two selectable limit positions for the pivotal angle of the hinge. In the end positions the projections 18 and 19 abut one another and constitute a stop. An important purpose of the angle-limiting arrangement is to prevent the hinge plates $1_6$ and $2_6$ from assuming, with their respective face oriented away from the drive-in points, a superposed, overlying relationship. Such an arrangement may be provided for both sides of the pivotal angle to be limited.

Figure 7:
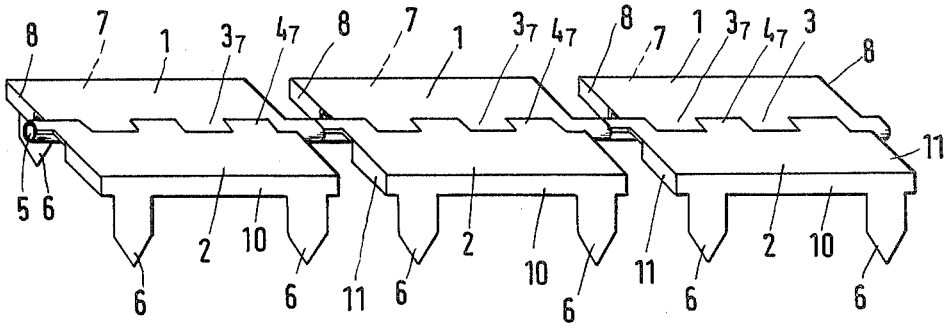
FIG. 7 is a perspective view of another preferred embodiment of the invention.

Turning now to FIG. 7, the embodiment shown therein is similar to that of FIG. 1. In the FIG. 7 embodiment, however, the hinge joints formed of the arcuately bent portions $3_7$ and $4_7$ and the throughgoing hinge pin 5 are at the underside of the hinge plates 1 and 2; stated differently, each hinge joint is situated at that face of the hinge plates 1 and 2, from which the drive-in points 6 extend.

Figure 8:
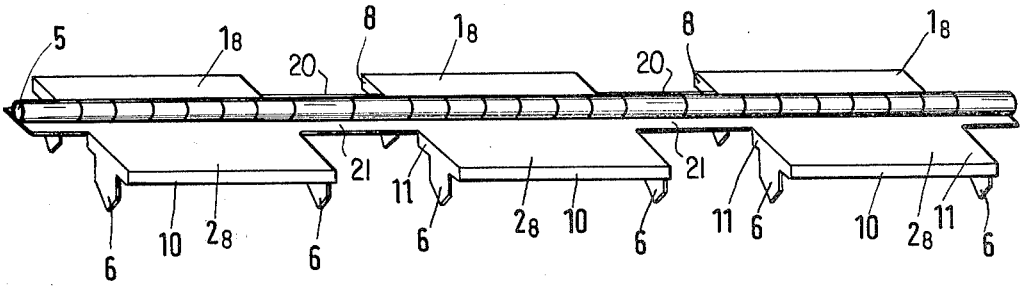
FIG. 8 is a perspective view of another preferred embodiment of the invention.

Turning now the embodiment illustrated in FIG. 8, the drive-in points 6 are not arranged in the plane of the rims 7 and/or 10 as in the previously described embodiments, but are provided at the transverse edges of the respective hinge plates $1_8$ and $2_8$ and are integral with the rims 8 and 11. The result of this arrangement is a greater spacing between the adjoining hinges. This makes possible to secure the individual hinges to one another not only by means of the throughgoing hinge pin 5, but also by means of connecting, coplanar, integral portions 20 of the hinge plates $1_8$ and $2_8$, respectively.

Figure 9:
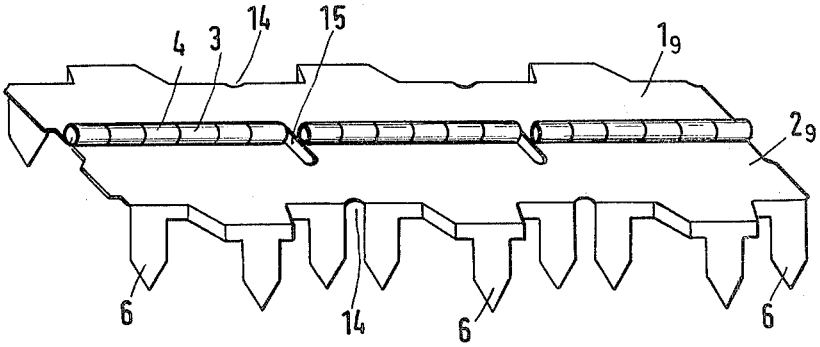
FIG. 9 is a perspective view of another preferred embodiment of the invention.

In the embodiment illustrated in FIG. 9 the basic shape of the individual hinge plates is a polygon having more than four sides. This makes possible to arrange the drive-in points 6 in more than one plane for the purpose of adapting the hinge assembly to the particular configuration of the article edges where the hinge assembly is to be mounted. The individual hinges of the hinge assembly are connected by continuous, throughgoing hinge plates $1_9$ and $2_9$. It is further feasible to effect such a connection solely by means of the hinge pin and to thus separate the hinge plates from one another into individual hinges.

In the various embodiments of the hinge assembly strip according to the invention the individual features are interchangeable independently from other features; for example, instead of connecting the individual hinges into a hinge assembly by the hinge pin, such connection may be effected by the hinge plates or conversely. The angularly bent rim may be provided at all bounding edges of the hinge plates or only along the longitudinal edges or only along the transverse edges. The hinge plates may be rectangular or may have any other shape; they may be flat-13 with the exception of the portions constituting the hinge joint—or they may be of embossed configuration to ensure a good adaptation to the shape of the article edges on which they are installed. The hinge joints may be on that side of the hinge plates where the drive-in points are located or may be on the opposite side. The hinge plates of the individual hinges may have a practically 360° angle of freedom for the pivotal motion or means may be provided to limit such an angle to a predetermined value. The drive-in points may be provided along the longitudinal edges and/or along the transverse edges and it is also feasible to arrange them in parallel planes.

It will be understood that the above description of the present invention is susceptible to various modifications, changes and adaptations, and the same are intended to be comprehended within the meaning and range of equivalents of the appended claims.

What is claimed is:

1. In a longitudinally extending hinge assembly strip of indeterminate length formed of a series of hinges connected to one another; each hinge including first and second hinge plates pivotally coupled along adjoining longitudinal edges by a hinge joint including a longitudinally extending hinge pin; the improvement wherein each said hinge plate has at least one free edge and a bent rim extending along said free edge and having a plane substantially perpendicular to the hinge plate, further wherein each hinge plate has at least one drive-in point being coplanar with said plane of said bent rim and further wherein said hinge pin is of indeterminate length and connects consecutive hinges to one another.

2. In a longitudinally extending hinge assembly strip of indeterminate length formed of a series of hinges connected to one another; each hinge including first and second hinge plates pivotally coupled along adjoining longitudinal edges by a hinge joint including a longitudinally extending hinge pin; the improvement wherein each said hinge plate has at least one free edge and a bent rim extending along said free edge and having a plane substantially perpendicular to the hinge plate, further wherein each hinge plate has at least one drive-in point being coplanar with said plane of said bent rim and further wherein each hinge plate has longitudinally and transversely extending free edges, each free edge being provided with a respective said bent rim; said drive-in points being provided on the bent rim associated with at least one of said free edges.

3. In a longitudinally extending hinge assembly strip of indeterminate length formed of a series of hinges connected to one another; each hinge including first and second hinge plates pivotally coupled along adjoining longitudinal edges by a hinge joint including a longitudinally extending hinge pin; the improvement wherein each said hinge plate has at least one free edge and a bent rim extending along said free edge and having a plane substantially perpendicular to the hinge plate, further wherein each hinge plate has at least one drive-in point being coplanar with said plane of said bent rim and further wherein said first and second hinge plates, together with the bent rims are mirror images of one another with respect to said hinge pin.

4. A hinge assembly strip as defined in claim 3, wherein consecutive first hinge plates and consecutive second hinge plates constitute continuous integral components of indeterminate length for connecting consecutive hinges to one another.

5. A hinge assembly strip as defined in claim 2 or 3, wherein each hinge plate has longitudinally and transversely extending free edges and each free edge is provided with a respective said rim; further wherein consecutive first hinge plates are spaced from and coupled to one another by first connecting members; further wherein consecutive second hinge plates are spaced from and coupled to one another by second connecting members; and further wherein said drive-in points are provided on said first and second connecting members and are situated in the plane of the rims associated with the longitudinal edges of the respective first and second hinge plates.

6. A hinge assembly strip as defined in claim 1, wherein each hinge plate is planar and has a rectangular outline.

7. A hinge assembly strip as defined in claim 3, wherein each hinge plate has a longitudinally extending elevated portion.

8. A hinge assembly strip as defined in claim 3, wherein each hinge plate has an outline having more than four sides.

9. A hinge assembly strip as defined in claim 15, 16 or 17, wherein each said hinge joint comprises interleaving parts of the first and second hinge plates constituting the respective hinge; said hinge pin being in an overlying relationship with respect to the hinge plates.

10. A hinge assembly strip as defined in claim 1, wherein each said hinge joint comprises interleaving parts of the first and second hinge plates constituting the respective hinge; said hinge pin being in an underlying relationship with respect to the hinge plates.

11. A hinge assembly strip as defined in claim 7, wherein each hinge comprises means for limiting the angle of pivotal movement of the first and second hinge plates for preventing faces of said hinge plates, oriented away from the respective drive-in points, from assuming a face-to-face overlying position.

12. A hinge assembly strip as defined in claim 11, wherein each said hinge joint comprises interleaving parts of the first and second hinge plates forming the respective hinge; at least some of said interleaving parts of one of the hinge plates of each hinge have an end face provided with at least one spirally extending first projection constituting an abutment; respective adjoining interleaving parts of the other of the hinge plates of each hinge have an end face provided with a second projection being rotationally symmetrical to an adjoining said first projection.

13. A hinge assembly strip as defined in claim 2, wherein said first and second hinge plates, together with the bent rims are mirror images of one another with respect to said hinge pin.

* * * * *